US009068445B2

(12) United States Patent
Read

(10) Patent No.: US 9,068,445 B2
(45) Date of Patent: Jun. 30, 2015

(54) SENSING INDICATOR HAVING RFID TAG, DOWNHOLE TOOL, AND METHOD THEREOF

(71) Applicant: Ellen E. Read, Houston, TX (US)

(72) Inventor: Ellen E. Read, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 381 days.

(21) Appl. No.: 13/716,668

(22) Filed: Dec. 17, 2012

(65) Prior Publication Data

US 2014/0166266 A1 Jun. 19, 2014

(51) Int. Cl.
*E21B 47/12* (2012.01)
*E21B 47/01* (2012.01)

(52) U.S. Cl.
CPC ..... *E21B 47/122* (2013.01); *E21B 47/011* (2013.01)

(58) Field of Classification Search
CPC ..... E21B 47/122; E21B 47/011; E21B 47/12; E21B 44/00; E21B 47/00; E21B 47/01; H04Q 9/00; G08B 26/00
See application file for complete search history.

(56) References Cited

U.S. PATENT DOCUMENTS

| | | | | |
|---|---|---|---|---|
| 6,408,943 | B1 | 6/2002 | Schultz et al. | |
| 6,540,019 | B2 | 4/2003 | Willauer | |
| 7,278,480 | B2 | 10/2007 | Longfield et al. | |
| 7,543,635 | B2 | 6/2009 | East et al. | |
| 8,342,242 | B2 * | 1/2013 | Roddy et al. | 166/255.1 |
| 2003/0043055 | A1 | 3/2003 | Schultz et al. | |
| 2008/0136619 | A1 | 6/2008 | Moran | |
| 2010/0139386 | A1 * | 6/2010 | Taylor | 73/152.23 |
| 2010/0174495 | A1 * | 7/2010 | Pereira et al. | 702/34 |
| 2011/0168403 | A1 * | 7/2011 | Patel | 166/373 |
| 2011/0248732 | A1 | 10/2011 | Zimmerman et al. | |
| 2012/0007801 | A1 | 1/2012 | Banning | |
| 2012/0193090 | A1 | 8/2012 | Lopez De Cardenas | |

OTHER PUBLICATIONS

University of Dayton, "A Smart Sensor", Engineering, Faculty, Research, http://www.udayton.edu/news/articles/2010/12/bob_kauffman_smart_sensors.php, Jan. 4, 2011, pp. 1-2.

* cited by examiner

*Primary Examiner* — Yong-Suk (Philip) Ro
(74) *Attorney, Agent, or Firm* — Cantor Colburn LLP

(57) ABSTRACT

A sensing indicator for a downhole tool, the sensing indicator includes a sensing mechanism including a sensing device and an RFID tag. Wherein the RFID tag is only readable when a set limit is exceeded. The set limit related to a sensed condition of a downhole component of the downhole tool; and, a housing supporting the sensing mechanism. The housing protecting the sensing mechanism from downhole conditions. Further is method of indicating whether a sensed condition of a downhole component in a downhole tool has exceeded a set limit

22 Claims, 6 Drawing Sheets

SENSING INDICATOR HAVING RFID TAG, DOWNHOLE TOOL, AND METHOD THEREOF

BACKGROUND

In the drilling and completion industry, the formation of boreholes for the purpose of production or injection of fluid is common The boreholes are used for exploration or extraction of natural resources such as hydrocarbons, oil, gas, water, and alternatively for CO2 sequestration. To create the borehole or subsequently operate within the borehole, a variety of downhole tools are employed.

Seals within and/or surrounding the downhole tools are used to protect the components therein from the unwanted ingress of fluids, particularly abrasive fluids that might deleteriously affect the internal structure of the tool to properly perform its intended function. In addition to protection, seals, including packers, plugs, and inflatable elements, are also used to redirect fluids from one pathway to another. Regardless of the intended use, the integrity of seals within a downhole tool is important; yet, it can be costly to monitor the downhole conditions in real time to ensure they remain within a safe margin for the sealing elements. This integrity can be compromised if a sealing component is subjected to an environment or usage beyond its designed limits.

In addition to seals, the downhole tools contain a large number of other components that are exposed to harsh environments within the borehole. Electronic assemblies and composites may be susceptible to damage in extreme temperatures. Even the body of the downhole tool itself can be damaged by strain through improper use such as by exceeding tensile, torsional, or compressive limits.

Time, manpower requirements, and mechanical maintenance issues are all variable factors that can significantly influence the cost effectiveness and productivity of a downhole operation. The art would be receptive to improved apparatus and methods for ascertaining and maintaining the integrity of components within a downhole environment.

BRIEF DESCRIPTION

A sensing indicator for a downhole tool, the sensing indicator includes a sensing mechanism including a sensing device and an RFID tag, wherein the RFID tag is only readable when a set limit is exceeded, the set limit related to a sensed condition of a downhole component of the downhole tool; and, a housing supporting the sensing mechanism, the housing protecting the sensing mechanism from downhole conditions.

A method of indicating whether a sensed condition of a downhole component in a downhole tool has exceeded a set limit, the method includes providing a sensing indicator including a sensing device and an RFID tag, the RFID tag readable only when a set limit is exceeded, the set limit related to a sensed condition of a downhole component of the downhole tool; attaching a housing of the sensing indicator to the downhole tool; employing the downhole component within a borehole; and interrogating the sensing mechanism of the sensing indicator to determine if the sensed condition has exceeded the set limit.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
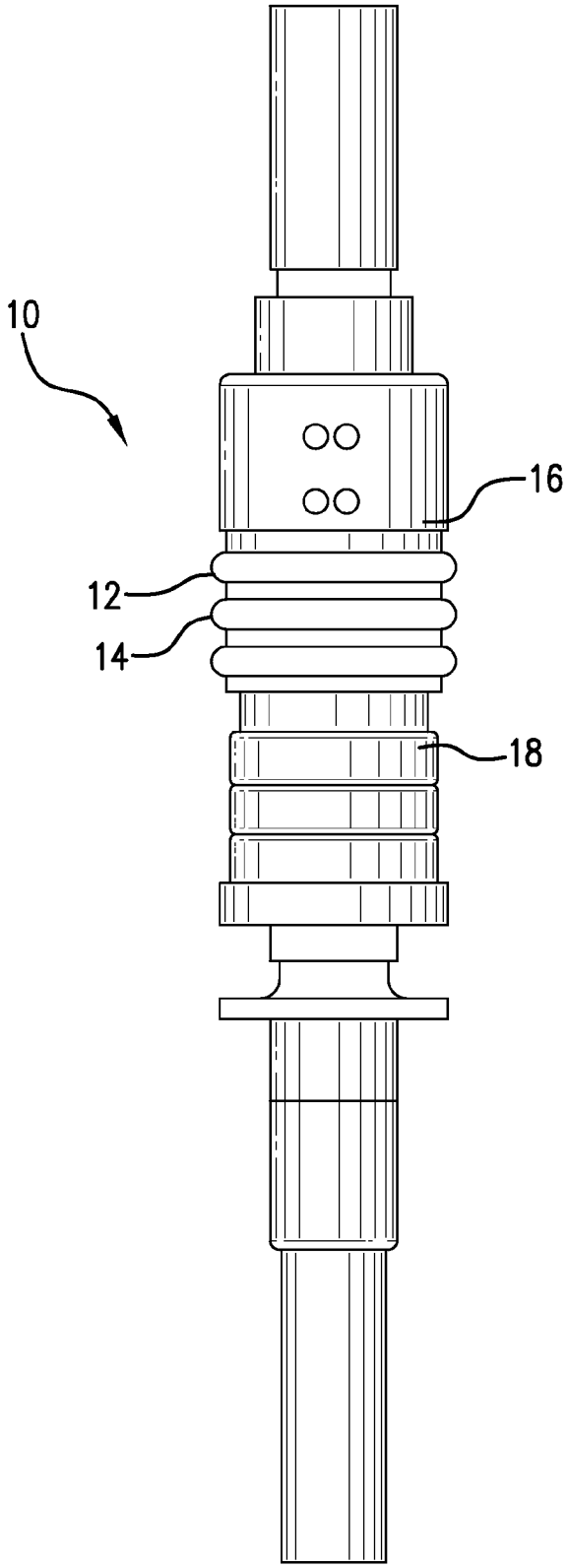
FIG. 1 shows a side plan view of an exemplary embodiment of a downhole tool.

FIG. 1 shows an exemplary downhole tool 10. In one exemplary embodiment, the downhole tool 10 includes a monitored component 12. The illustrated monitored component 12 includes a seal 14 useful as a packing element assembly, although other sealing components can be included within the downhole tool 10. The seal 14 is a temperature sensitive element, meaning that the seal 14 could become damaged, require replacement, or otherwise not function as intended if exposed to certain temperature conditions. Other temperature sensitive elements as monitored components 12 may also be included within the downhole tool including, but not limited to, electronic components and composite materials. In another exemplary embodiment, the downhole tool 10 alternatively or additionally includes a pressure sensitive element as the monitored component 12. While the illustrated pressure sensitive element 12 is also the seal 14, the downhole tool 10 may further include other pressure sensitive elements including, but not limited to, bridge plugs, frac plugs, and inflatable elements. While designed for downhole use within a borehole and capable of withstanding normal operating conditions, the monitored components 12 of the downhole tool 10 are nonetheless additionally susceptible to damage when used outside of an acceptable range, including an overload of temperature, pressure, tension, torque, or compression.

Prior to use, the downhole tool 10 and/or monitored components 12 thereof, are rated for running conditions including at least one of a maximum temperature, pressure, tension, torque, and compression. As will be further described below, the downhole tool 10 is further outfitted with at least one sensing indicator 16 that will enable an operator to quickly and easily determine if one or more of the rated running conditions have been exceeded.

In an exemplary embodiment of the sensing indicator 16, the sensing indicator 16 is located adjacent a selected monitored component 12 of the downhole tool 10 that is to be monitored. By "monitored" it should be understood that the component 12 has at least one sensitivity to a particular condition, such as temperature, pressure, tension, torque, and compression, and the sensing indicator 16 will indicate through readability, as will be further described below, if the condition has exceeded a preselected rating. In the illustrated embodiment, a first sensing indicator 16 is positioned uphole of the seal 14 and a second sensing indicator 18 is positioned on downhole of the seal 14. The use of multiple sensing indicators 16, 18 is depicted in one exemplary embodiment to monitor the same component 12 because conditions can vary greatly from one side of the monitored component 12 to the other, particularly with respect to pressure. However, while two sensing indicators 16, 18 are shown, it would also be within the scope of these embodiments to include a single sensing indicator adjacent a component 12 to be sensed if the sensed condition is not anticipated to substantially vary between an uphole and downhole end of the monitored component 12.

Figure 2:
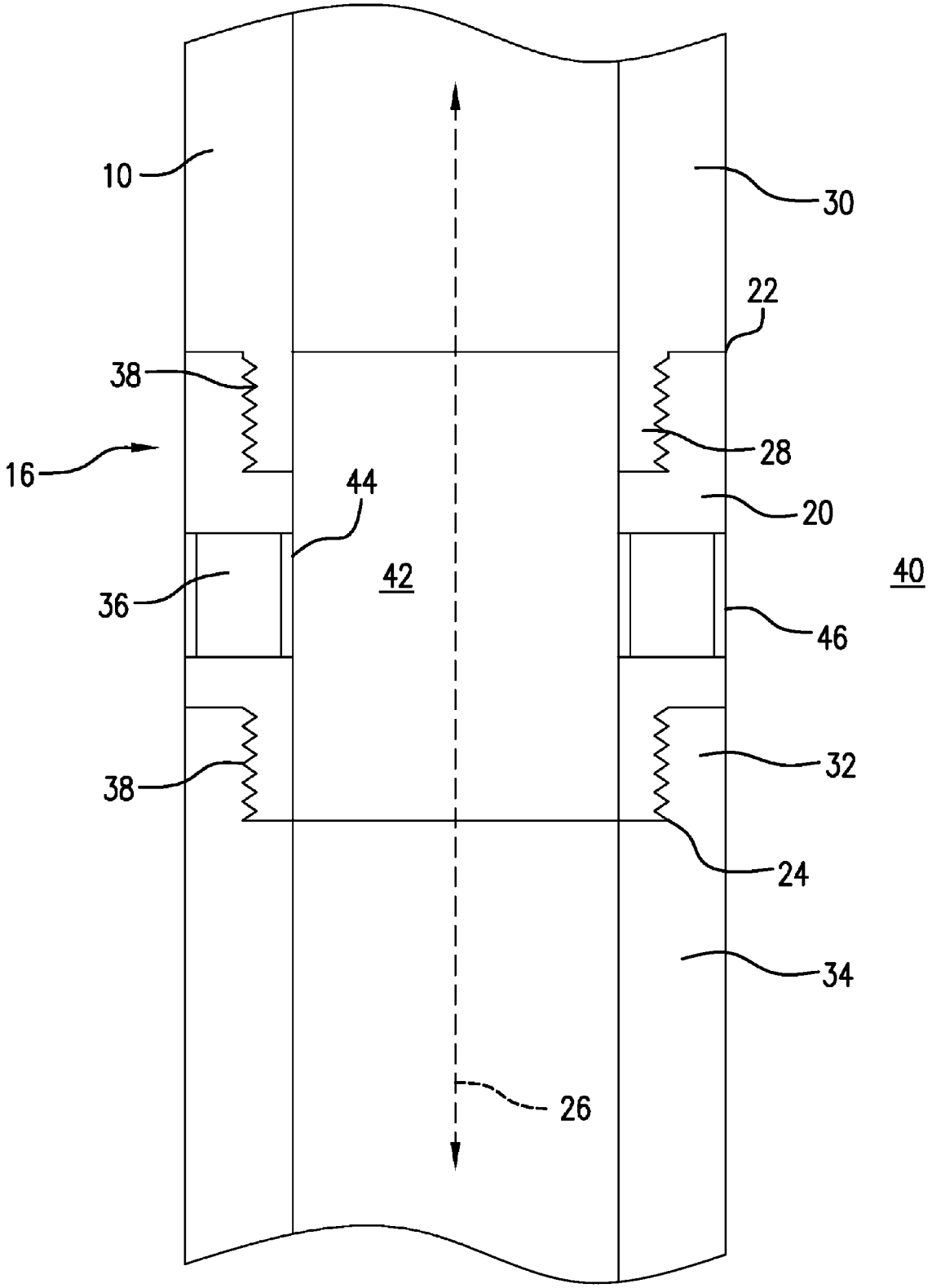
FIG. 2 shows a side cross-sectional view of an exemplary embodiment of a sensing indicator.

FIG. 2 depicts one exemplary embodiment of the sensing indicator 16. The sensing indicator 16 includes a housing 20 having a first end 22 and a second end 24. The housing 20 is tubular shaped with a longitudinal axis 26 substantially aligned with a longitudinal axis of the downhole tool 10. The housing 20 thus allows for the passage of fluid flow there through, as does the downhole tool 10. While the first end 22 of the housing 20 is illustrated as connected to a downhole end 28 of a first component 30 of the downhole tool 10 and the second end 24 of the housing 20 is illustrated as connected to an uphole end 32 of a second component 34 of the downhole tool 10, a sensing mechanism 36 may be arranged within the housing 20 such that the sensing indicator 16 is employable in a flipped configuration, depending on how threads 38 of the components 30, 34 of the downhole tool 10 are arranged. That is, the sensing mechanism 36 need not be orientation specific. Each of the first end 22 and the second end 24 of the housing 20 includes a connection part, such as threads 38, for connection with the adjacent downhole components 30, 34. While the first end 22 is shown as a female end and the second end 24 is shown as a male end, the housing 20 could be designed to have two female ends or two male ends for connection with adjacent components 30, 34. The sensing mechanism 36 is positioned within the housing 20 such that it is sufficiently exposed to the environment it is designed to sense or monitor. The sensing mechanism 36 can therefore be arranged within the housing 20 to sense or monitor either an exterior 40 of the downhole tool 10, an interior 42 of the downhole tool 10, or both as illustrated. If the condition to be monitored is tension, compression, or torque, then the proximity of the sensing mechanism 36 to the monitored component 12 is more critical than the proximity of the sensing mechanism 36 to the environment 40, 42. The sensing mechanism 36 is further sealed from exposure to downhole fluids by at least one of an interior protector 44 and an exterior protector 46. The above-described sensing indicator 16 advantageously allows for modular use adjacent a variety of downhole components 30, 32. While a separate housing 20 has been shown to house the sensing mechanism 36 within the sensing indicator 16, alternatively, due to space constraints, the sensing mechanism 36 may alternatively be integrated with or within the component 12 and would share a housing with or otherwise be housed by the component 12.

Figure 3:
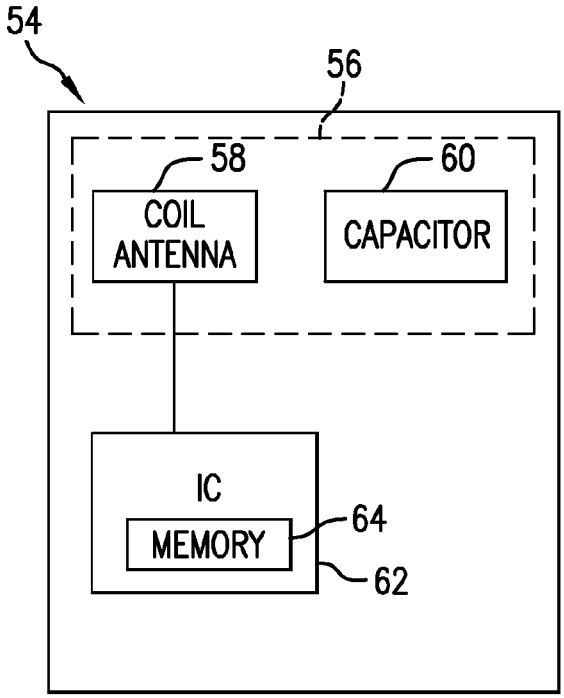
FIG.3 PRIOR ART
FIG. 3 shows a block diagram of an RFID tag according to the prior art.
Figure 4:
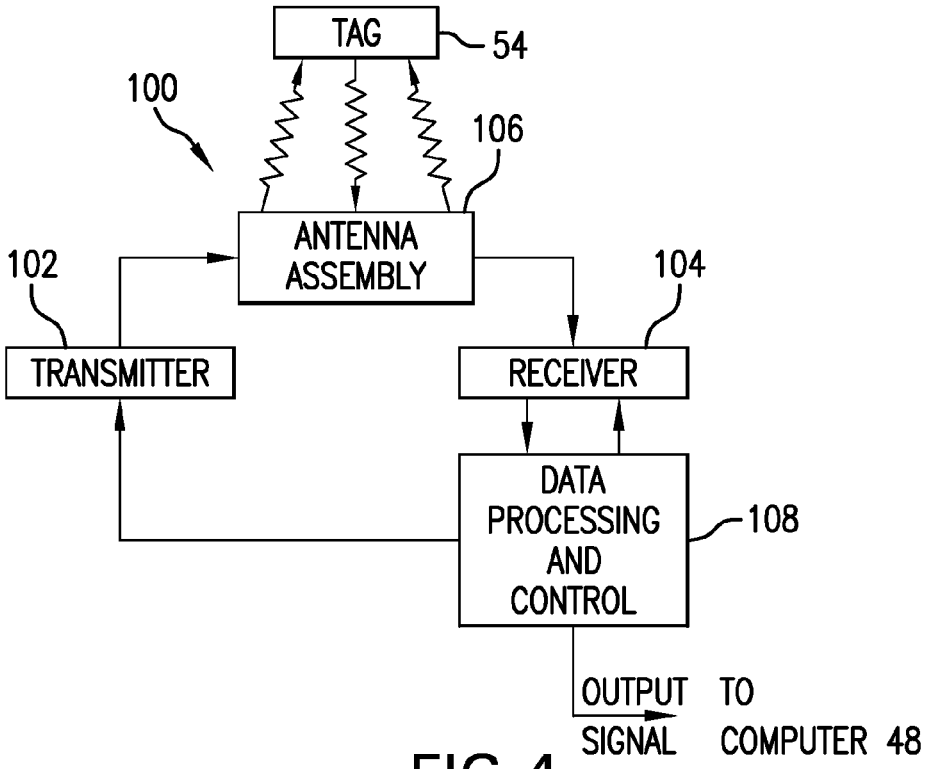
FIG.4 PRIOR ART
FIG. 4 shows a block diagram of an interrogator according to the prior art for use in reading the tag of FIG. 3.

In the exemplary embodiments described herein, the sensing mechanism 36 of the sensing indicator 16 includes a "smart" active radiofrequency identification ("RFID") tag. A typical RFID tag includes a lamination of materials, adhesive, and a flexible PET substrate, however, for the purposes of monitoring downhole conditions via the sensing indicator 16, the RFID tag for the sensing indicator 16 includes materials that are selected for long-term reliability and longevity within the anticipated conditions of a borehole and on a downhole tool 10. A typical operation of a prior art passive RFID tag 54 and its reader 100 is shown in FIGS. 3 and 4. FIG. 3 shows general details of a sample RFID tag 54, which includes a passive resonant radio frequency ("RF") circuit 56 for use in detecting when the tag 54 is within a zone monitored by a reader or interrogator. The circuit 56 has a coil antenna 58 and a capacitor 60, which together form a resonant circuit with the selected RF. The tag 54 also includes an integrated circuit ("IC") 62 for providing intelligence to the tag and includes a memory 64. FIG. 4 shows a reader or interrogator 100 suitable for use with the tag 54. The interrogator 100 includes a transmitter 102, receiver 104, antenna assembly 106, and data processing and control circuitry 108. When the tag 54 comes within the range of the interrogator 100, the tag 54 receives an electromagnetic signal from the interrogator 100 through the antenna 58 of the tag 54. The tag 54 then stores the energy from the signal in the capacitor 60, a process called inductive coupling. When the capacitor 60 has built up enough charge, it can power the circuit 56 of the tag 54 to transmit a modulated signal to the interrogator 100. That signal contains the information stored in the tag 54. The tag 54 of FIG. 3 is a passive type tag because it does not include an on board battery that powers the circuit 56, and instead draws its power from the interrogator 100. The receiver 104 of the interrogator receives the signal, which is processed by the control 108, and an output signal is sent to a computer 48.

The RFID tag 54 described with respect to FIGS. 3 and 4 will always relay a signal upon inquiry by the interrogator 100, and will require stored energy received from the interrogator 100 to operate. On the contrary, the smart or intelligent RFID tag in the exemplary embodiments for the sensing indicator 16 is an active RFID tag. Also, the tag in the sensing indicator 16 does not receive source voltage to activate the RFID tag to become readable unless a particular downhole condition exceeds a set limit or rating. In one exemplary embodiment, the downhole condition is an excessive temperature that could potentially deteriorate the sealing properties or material of the seal 14 or other temperature-sensitive downhole component 12. The RFID tag in this case would be a temperature triggered RFID tag. In another exemplary embodiment, the downhole condition is an excessive pressure that could likewise impact the seal 14 or other pressure-sensitive downhole component 12. The RFID tag in this case would be a pressure triggered RFID tag. In another exemplary embodiment, the downhole condition is an excessive torque, tension, or compression experienced by the downhole tool 10. The RFID tag in this case would be a strain triggered RFID tag. For any of the monitored downhole conditions, if the limit or predetermined rating is not exceeded, then the RFID tag within the sensing indicator 16 is not readable and no signals are sent to a reader when interrogated. That is, an operator will only be notified if a condition experienced by the downhole component has been outside of an acceptable limit. In the RFID tag of the sensing indicator 16, once the condition is met, for example an excessive temperature is experienced at the seal 14, then the RFID tag will be triggered to become readable, and will remain readable. Thus, once a tag is readable, an operator will know, such as through the use of a reader, that the seal 14 has experienced an unacceptable condition at least some point during its use. An operator can then decide upon further inspection if replacement or repair is warranted.

Figure 5:
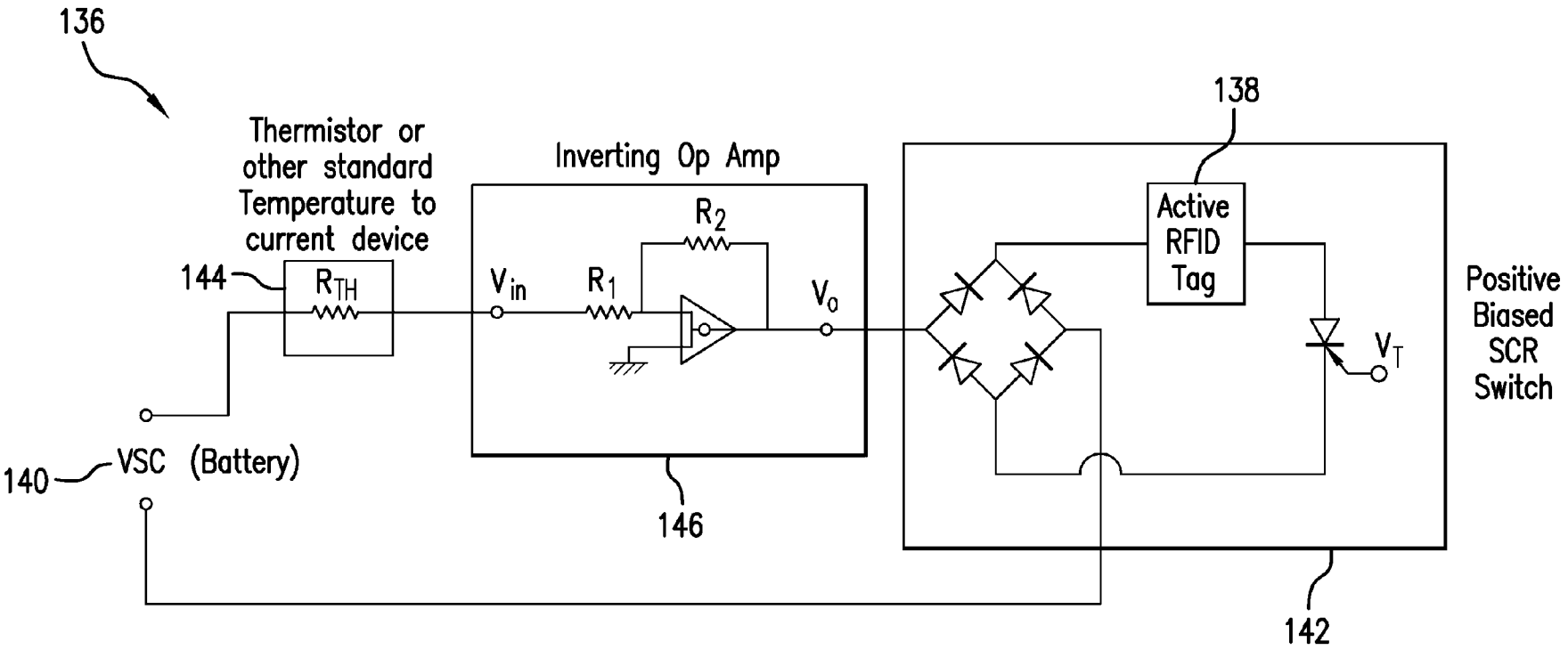
FIG. 5 shows a circuit diagram of an exemplary embodiment of a sensing mechanism with a temperature-sensitive RFID tag.

FIG. 5 shows a circuit diagram of an exemplary sensing mechanism 136 including a temperature triggered RFID tag 138 for the sensing indicator 16. The sensing mechanism 136 includes a power source 140, such as a battery $V_{SC}$. The power source 140 is connected to a sensing device including a thermistor 144 or other standard temperature-to-current device $R_{TH}$. The output voltage of the thermistor 144 is inversely proportional to the temperature sensed by the sensing device.

Connected to the thermistor 144 is an inverting operational amplifier ("Op Amp") 146, which receives the voltage $V_{in}$ from the device $R_{TH}$ to output voltage $V_o$ which is proportional to the temperature. The inverting Op Amp 146 then outputs the output voltage $V_o$ to a bridge rectifier of the positive biased SCR switch circuit 142. If the output voltage $V_o$ exceeds set limit $V_T$, then the positive biased SCR switch circuit 142 powers the active RFID tag 138 thus enabling the RFID tag 138 to be read. The circuit within the RFID tag is connected to the circuit 142 and thus is incomplete until the occurrence of $V_o>V_T$, at which point the circuit 142 is switched to power the RFID tag 138.

The power source 140 is only necessary to allow the silicon controlled rectifier ("SCR") switch circuit 142 to be triggered on, allowing the RFID tag 138 to read. Once the set limit $V_T$ is exceeded, the power source 140 is no longer needed. That is, if the RFID tag 138 does not have a source permanently energizing it (wire line or control line) after trigger, the duration it can be read is the life of the power source (battery) 140. Once battery life is exceeded, the circuit 142 will need to be re-energized in order to read. Changing the battery 140, however, does not erase the memory within the RFID tag 138, and therefore the memory of the event that caused the RFID tag 138 to read, will still be readable once the power source 140 is replaced. For example, if the set limit $V_T$ is exceeded, and then the battery dies and the tool 10 is subsequently recovered, the battery can be changed and the RFID tag 138 will still show that the limit was exceeded due to the positive biased SCR switch circuit 142 that is used to trigger energizing the RFID tag 138. Since the lifespan of batteries for particular jobs can be predetermined, a power source 140 can be chosen that will have sufficient life for the duration of a selected operation of the downhole tool 10. While the power source 140 has been described as a battery, control lines could alternatively be used to power the sensing indicator 16.

In an exemplary method of employing the temperature triggered RFID tag 138 to detect an unwanted seal condition relating to temperature, a reading device, such as interrogator 100 or any reader suitable for reading an active RFID tag, is held up or otherwise placed in proximity to the tag 138 adjacent the seal 14. If the RFID tag 138 is transmitting, then that is an indication to an operator or connected system control that the set temperature limit, i.e. $I_f$ current limit, has been exceeded during the lifetime of the tag 138. If the tag 138 is not transmitting, then the power source should be checked, and if the power source still provides source voltage, then it can be assumed that the sensing mechanism 136 did not experience a temperature exceeding a set rating. An operator should further insure that the tag 138 is unreadable prior to attachment to the downhole tool 10 and prior to introduction into the borehole so that the readability of the RFID tag 138 can be attributed correctly to downhole conditions.

Figure 6:
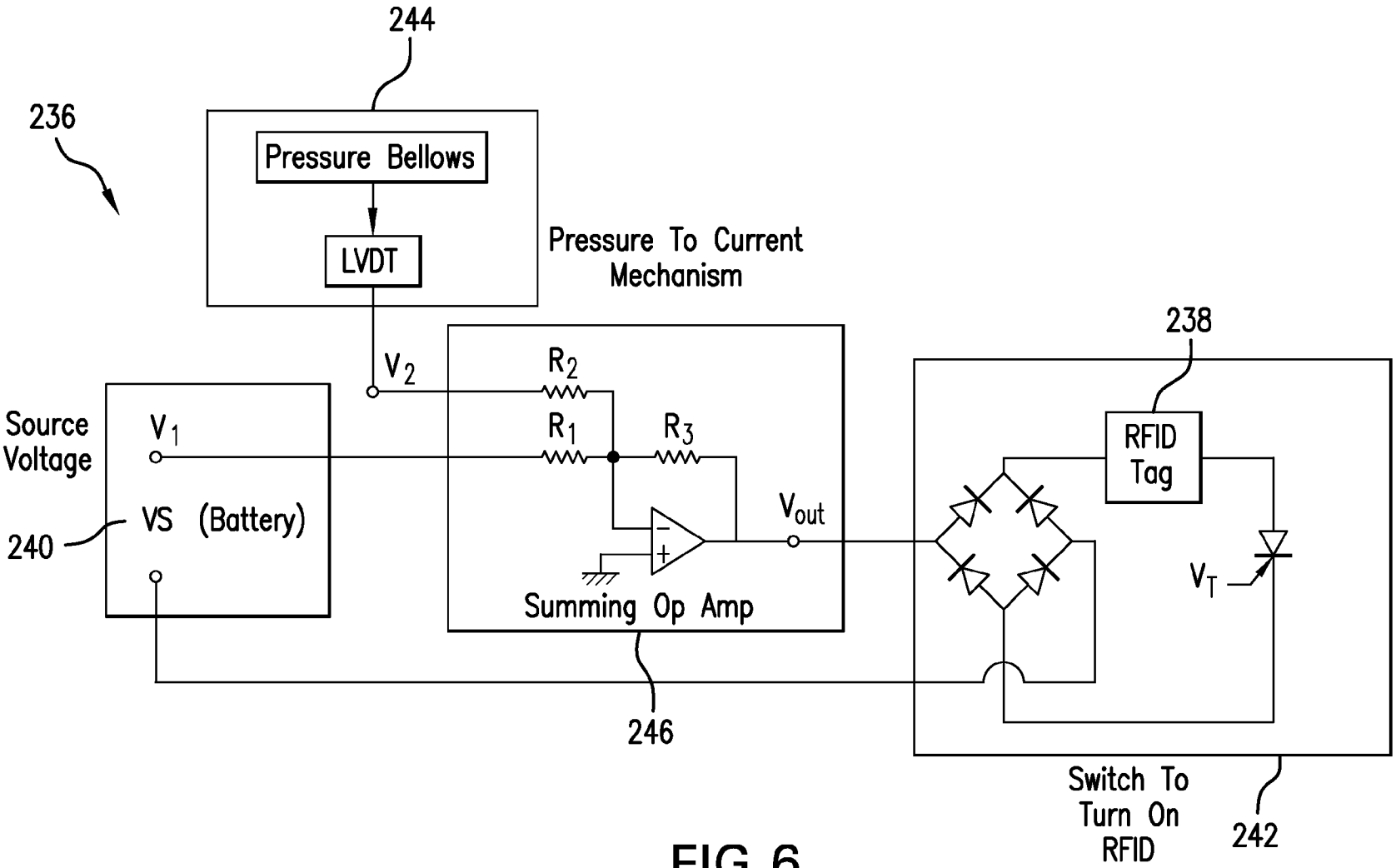
FIG. 6 shows a circuit diagram of an exemplary embodiment of a sensing mechanism with a pressure-sensitive RFID tag; and, FIG. 7 shows a circuit diagram of an exemplary embodiment of a sensing mechanism with a strain-sensitive RFID tag.

FIG. 6 shows a circuit diagram of an exemplary sensing mechanism 236 including a pressure triggered RFID tag 238. The pressure triggered RFID tag 238 also includes a power source 240, such as battery or wire line $V_S$ providing a source voltage. The voltage from the power source 240 is sent to a summing Op Amp 246 as $V_1$. A pressure sensing device includes a pressure to current mechanism 244, such as one that includes pressure bellows, to a linear variable differential transformer ("LVDT"), to output voltage $V_2$ to the summing Op Amp 246. The summing Op Amp 246 uses the voltage $V_1$ and Voltage $V_2$ to output the output voltage $V_{out}$ to the positive biased SCR switch circuit 242. This switch circuit 242 may be similar to the positive biased SCR switch circuit 142 used for the temperature triggered RFID tag 138, except that the set limit $V_T$ is different. In this embodiment, the switch circuit 242 to turn on the RFID tag 238 is turned on if $V_S+V_2>V_T$. The trigger voltage (set limit $V_T$) equals the sum of the resultant voltage from the pressure to current mechanism $V_2$ and the source voltage $V_S$. As in the circuit 142, the switch circuit 242 does not allow current flow through the RFID tag 238 until the set limit $V_T$ is exceeded. Once triggered, it allows current flow to the RFID tag 238. As with the temperature triggered RFID tag 138, once the set limit $V_T$ is exceeded, a memory of the event that caused the trigger of the RFID tag 238 is maintained therein.

Figure 7:
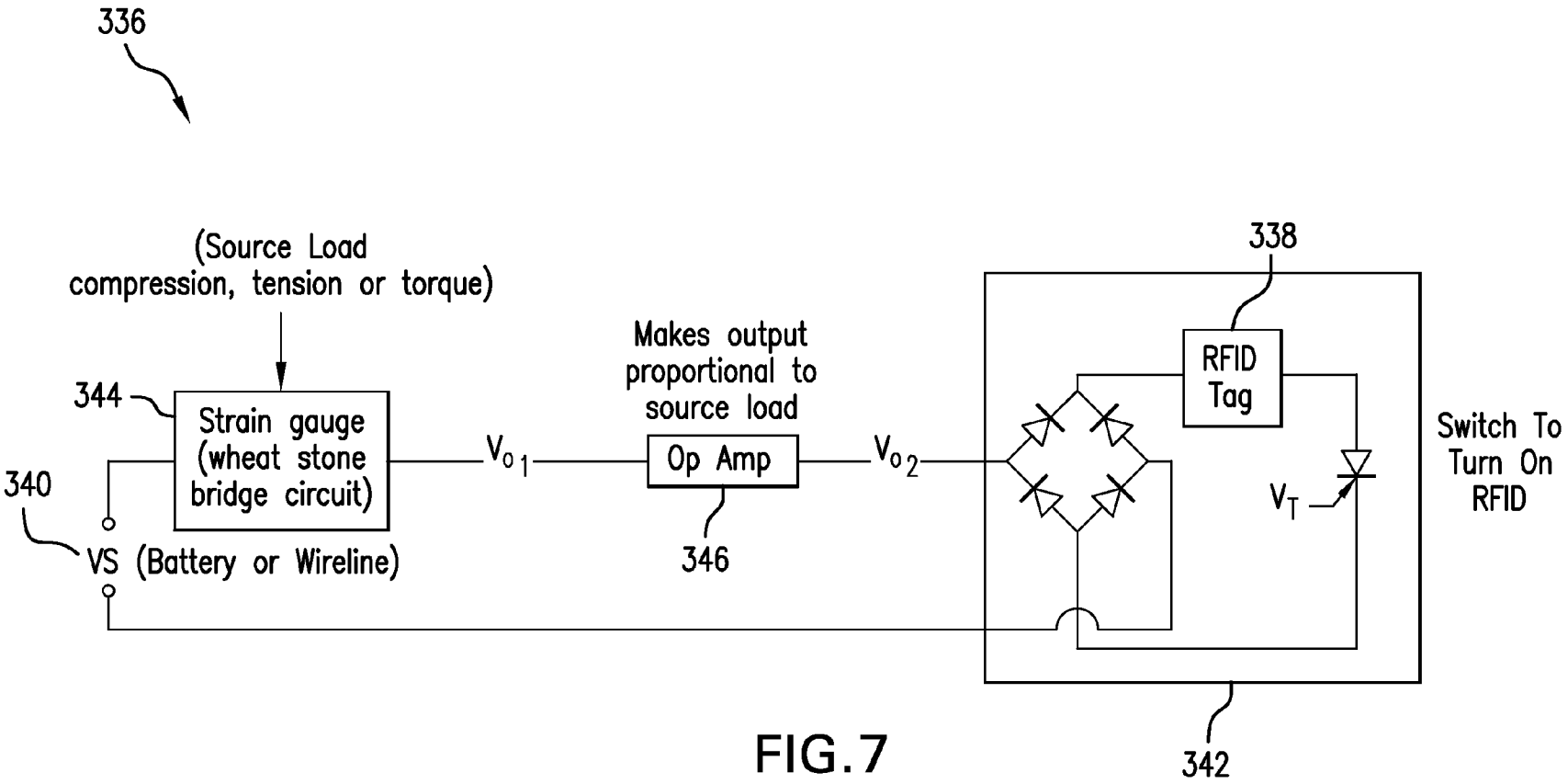

FIG. 7 shows a circuit diagram of an exemplary torque, tension, and or compression sensing mechanism 336 including a strain triggered RFID tag 338. The sensing mechanism 336 also includes a power source 340, such as a battery or wire line, providing a source voltage $V_{SC}$. The strain sensing device includes a strain gauge 344, using a Wheatstone bridge circuit, and detects the source compression, tension, or torque and provides a source load $Vo_1$ to the Op Amp 346 to provide an output $Vo_2$ proportional to the source load. The output $Vo_2$ is provided to the SCR switch circuit 342 in a manner described above. The trigger voltage (set limit $V_T$) once exceeded allows the RFID tag 338 to be energized and read. The set limit $V_T$ is set to a voltage proportional to the load limit. The tags 138, 238, 338, while used in different sensing mechanisms 136, 236, 336, may themselves be identical.

In any of the above-described embodiments, all circuits must be protected from borehole fluids by a circuit housing that is sealed internally to the tool 10. The internal distance from the environment 40, 42 to the sensing mechanism 36 or the distance from the sensing mechanism 36 to the monitored component 12 may have some effect on the temperature, pressure, or strain at the sensing mechanism 16, but this effect may be compensated for electrically by a change in the set limit $V_T$ if necessary. For example, the set limit $V_T$ may be lowered or increased if it is found that the circuit housing 20 decreases or increases the temperature or pressure sensed by the sensing mechanisms 126, 236, respectively. Each of the above-described sensing mechanisms 136, 236, 336 will measure a one time, instantaneous excess of the set limit $V_T$. In these cases, the limitations for application of the RFID tags 138, 238, 338 will be its own temperature and pressure limits. If the sensing indicator 16 is run on downhole battery power, this will limit the maximum operating temperature. If it is run on wire line, it will have a higher maximum operating temperature (and lifespan) than if run on downhole battery power. While running the sensing indicator 16 on wire line is advantageous in some respects, the ability to easily secure the sensing indicator 16 to any downhole component such as shown in FIGS. 1 and 2 is also advantageous in its simplicity and modularity. Furthermore, since the lifespan and ratings of batteries and RFID tags can be ascertained prior to inclusion in the sensing indicator 16, it can be easily determined if the sensing indicator 16 is usable with a monitored component 12 for particular downhole operations and durations thereof. Larger batteries for greater lifespans as well as more durable components to survive expected extreme downhole conditions can be provided to components of the sensing indicator 16 as needed.

The sensing indicator 16 can include one or more of the above-described sensing mechanisms 136, 236, 336. For example, the sensing indicator 16 could include both a temperature-triggered RFID tag 138 as well as a pressure-triggered RFID tag 238. The sensing indicator 16 can be provided alongside retrievable temperature and pressure limited components 12 on run on rental tools, wire line, or drill string to ensure that product ratings are not exceeded. The sensor trigger voltage will be equated to the rated temperature, pressure, torque, tensile or compression limit to be conveyed to the circuit by appropriate sensing devices including but not limited to temperature sensors, pressure sensors, and strain gauges. The sensing indicator 16 can be used for post-run investigation of rental tools in order to insure that downhole or miming conditions have not voided tool warranty (rated limits). Some exemplary embodiments of use include placing the sensing indicator 16 above and below sealing components such as packers, bridge plugs, frac plugs, and inflatable elements, alongside temperature critical materials such as composites and rubbers, on any rental tool component or feature that may potentially be overloaded in tension, torque, or compression, and alongside temperature limited electronic assemblies. While the sensing mechanism 36 has been described as providing an indication of undesirable conditions, another potential use includes ensuring that certain desirable conditions have been met. For example, a sensing indicator 16 having a pressure-triggered RFID tag 238 can be placed within a downhole tool 10 where exceeding a given pressure is critical to the function of the tool. 10 If the tool 10 does not operate as designed, an attempt to read the sensing indicator 16 can be performed to determine if the required pressure was indeed exceeded as required.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items.

What is claimed:

1. A sensing indicator for a downhole tool, the sensing indicator comprising:

a sensing mechanism including a sensing device, a radiofrequency identification tag, and a switch, the sensing device arranged to sense a sensed condition of a downhole component of the downhole tool, the sensed condition including at least one of a temperature, pressure, and strain condition, wherein the radiofrequency identification tag is unreadable before the sensed condition exceeds a set limit, the switch configured to automatically trigger the radiofrequency identification tag from unreadable to readable upon the sensed condition exceeding the set limit, and the radiofrequency identification tag configured to remain readable after the set limit is exceeded; and, a housing supporting the sensing mechanism, the housing protecting the sensing mechanism from downhole conditions.

2. The sensing indicator of claim 1, wherein the housing is tubular allowing fluid flow there through.

3. The sensing indicator of claim 2, wherein the housing includes threads engageable with threads of the downhole component.

4. The sensing indicator of claim 1 wherein the switch does not allow current to flow through the radiofrequency identification tag until the set limit is exceeded.

5. The sensing indicator of claim 4, wherein the sensing mechanism includes a source voltage between the switch and the sensing device, the switch configured to prevent the source voltage from powering the radiofrequency identification tag before the set limit is exceeded, and the source voltage powering the radiofrequency identification tag after the set limit is exceeded.

6. The sensing indicator of claim 1, wherein the sensing device includes one of a temperature sensor, pressure sensor, and a strain gauge.

7. A downhole tool comprising:

a downhole component sensitive to the sensed condition; and, a sensing indicator as claimed in claim 1.

8. The downhole tool of claim 7, wherein the housing is tubular allowing flow there through.

9. The downhole tool of claim 7, wherein the housing is threaded to adjacent components of the downhole tool.

10. The downhole tool of claim 7, wherein the downhole component is a seal.

11. The downhole tool of claim 10, wherein the sensing indicator is a first sensing indicator positioned uphole of the seal, the downhole tool further comprising a second sensing indicator positioned downhole of the seal.

12. A method of indicating whether a sensed condition of a downhole component in a downhole tool has exceeded a set limit, the method comprising:

providing a sensing indicator including a sensing mechanism, the sensing mechanism including a sensing device, a radiofrequency identification tag, and a switch, the sensing device arranged to sense a sensed condition of the downhole component of the downhole tool, the sensed condition including at least one of a temperature, pressure, and strain condition, wherein the radiofrequency identification tag is unreadable before the sensed condition exceeds a set limit, the switch configured to automatically trigger the radiofrequency identification tag from unreadable to readable upon the sensed condition exceeding the set limit, and the radiofrequency identification tag configured to remain readable after the set limit is exceeded;

attaching a housing of the sensing indicator to the downhole tool;

employing the downhole component within a borehole; and interrogating the sensing mechanism of the sensing indicator to determine whether the sensed condition has exceeded the set limit.

13. The method of claim 12, wherein interrogating the sensing mechanism occurs subsequent removing the downhole tool from the borehole.

14. The method of claim 12, wherein interrogating the sensing mechanism includes running a radiofrequency identification reader downhole towards the sensing indicator.

15. The method of claim 12, wherein providing a sensing indicator includes providing a first sensing indicator uphole of the downhole component and a second sensing indicator downhole of the downhole component, both the first and second sensing indicators indicating whether the sensed condition of the downhole component has exceeded the set limit.

16. The method of claim 12, wherein the downhole component is a seal.

17. The method of claim 12, wherein interrogating the sensing mechanism of the sensing indicator to determine whether the sensed condition has exceeded the set limit includes determining that the downhole tool has voided a tool warranty by exceeding the set limit.

18. The method of claim 12, further comprising setting the set limit as a voltage proportional to a strain limit of the downhole component.

19. The method of claim 12, further comprising setting the set limit as a voltage proportional to a temperature rating of the downhole component.

20. The method of claim 12, further comprising setting the set limit as a voltage proportional to a sum of pressure rating of the downhole component and a source voltage.

21. The method of claim 12, further comprising reading the radiofrequency identification tag when the radiofrequency identification tag is readable, and checking a source voltage to the sensing mechanism when the radiofrequency identification tag is unreadable.

22. The method of claim 12, further comprising, prior to employing the downhole component within a borehole, interrogating the sensing mechanism to ensure that the radiofrequency identification tag is not readable.

* * * * *